US008979237B2

(12) United States Patent
Yamada

(10) Patent No.: US 8,979,237 B2
(45) Date of Patent: Mar. 17, 2015

(54) RECORDING HEAD CONTROL METHOD AND DOT IMPACT PRINTER

(75) Inventor: Takefumi Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 652 days.

(21) Appl. No.: 12/963,533

(22) Filed: Dec. 8, 2010

(65) Prior Publication Data

US 2011/0157266 A1 Jun. 30, 2011

(30) Foreign Application Priority Data

Dec. 25, 2009 (JP) ..... 2009-294060
Jun. 11, 2010 (JP) ..... 2010-133686
Jun. 11, 2010 (JP) ..... 2010-133687

(51) Int. Cl.
*B41J 29/38* (2006.01)
*B41J 2/30* (2006.01)

(52) U.S. Cl.
CPC ..... *B41J 2/30* (2013.01)
USPC ..... 347/17; 347/9; 347/14

(58) Field of Classification Search
USPC ..... 347/5–18
See application file for complete search history.

(56) References Cited

U.S. PATENT DOCUMENTS 7,219,972 B2 * 5/2007 Kanematsu et al. ..... 347/14
7,352,380 B2 4/2008 Takano et al.

FOREIGN PATENT DOCUMENTS

JP 6305164 A 11/1994
JP 7178935 A 7/1995
JP 2002192759 A 7/2002
JP 2002264370 A 9/2002
JP 2003127441 A 5/2003
JP 2003127442 A 5/2003
JP 2004-098617 * 4/2004 ..... B41J 2/30
JP 2004098617 A 4/2004
JP 2006-256059 A 9/2006
JP 2008018548 A 1/2008

* cited by examiner

*Primary Examiner* — Uyen Chau N Le
*Assistant Examiner* — Chad Smith
(74) *Attorney, Agent, or Firm* — Lowe Hauptman & Ham, LLP

(57) ABSTRACT

A recording head control method prevents head coil burnout caused by heat output while suppressing a drop in printer throughput. A control method for a recording head 18 of a dot impact printer 100 that prints information on a recording medium S by driving the recording wires 9 of a recording head 18 that has a plurality of recording wires 9 while a carriage 19 that carries the recording head 18 traverses the recording medium S, each of the recording wires 9 being allocated to printing one dot line in the scanning direction of the carriage 19, the control method including steps of: during dot line printing, determining before printing if the number of previously defined specific dot patterns P1, P2 contained in the dot line to be printed is greater than or equal to a reference number N of 2 or more; and printing the dot line based on the result of the decision.

16 Claims, 12 Drawing Sheets

| PRINT MODE | | SYMBOL | CHARACTER QUALITY | | | |
|---|---|---|---|---|---|---|
| | | | DRAFT MODE | | LETTER QUALITY MODE | |
| | | | NOT-SPECIFIC BIT IMAGE | SPECIFIC BIT IMAGE | NOT-SPECIFIC BIT IMAGE | SPECIFIC BIT IMAGE |
| NORMAL | PRINT INTERVAL CONDITION | Rin | 3.063KΩ | 10.29KΩ | 3.063KΩ | 10.29KΩ |
| | | | (t ≥102°C) | (t ≥65°C) | (t ≥102°C) | (t ≥65°C) |
| | UNIDIRECTIONAL PRINT CONDITION | Rhh | 2.639KΩ | 7.267KΩ | 2.639KΩ | 7.267KΩ |
| | | | (t ≥107°C) | (t ≥75°C) | (t ≥107°C) | (t ≥75°C) |
| | STOP PRINTING CONDITION | Rst | 2.418KΩ | 2.639KΩ | 2.418KΩ | 2.639KΩ |
| | | | (t ≥110°C) | (t ≥107°C) | (t ≥110°C) | (t ≥107°C) |
| | HEAD COIL DRIVE INTERVAL | Tin 1 | 90msec | 115msec | 80msec | 115msec |
| | | Tin 2 | 140msec | 165msec | 130msec | 165msec |
| COPY | PRINT INTERVAL CONDITION | Rin | 3.063KΩ | 10.29KΩ | 3.063KΩ | 10.29KΩ |
| | | | (t ≥102°C) | (t ≥65°C) | (t ≥102°C) | (t ≥65°C) |
| | UNIDIRECTIONAL PRINT CONDITION | Rhh | 2.639KΩ | 7.267KΩ | 2.639KΩ | 7.267KΩ |
| | | | (t ≥107°C) | (t ≥75°C) | (t ≥107°C) | (t ≥75°C) |
| | STOP PRINTING CONDITION | Rst | 2.418KΩ | 2.639KΩ | 2.418KΩ | 2.639KΩ |
| | | | (t ≥110°C) | (t ≥107°C) | (t ≥110°C) | (t ≥107°C) |
| | HEAD COIL DRIVE INTERVAL | Tin 1 | 100msec | 130msec | 130msec | 160msec |
| | | Tin 2 | 150msec | 180msec | 180msec | 210msec |

FIG. 8

| PRINT MODE | | SYMBOL | CHARACTER QUALITY | | | |
|---|---|---|---|---|---|---|
| | | | DRAFT MODE | | LETTER QUALITY MODE | |
| | | | NOT-SPECIFIC BIT IMAGE | SPECIFIC BIT IMAGE | NOT-SPECIFIC BIT IMAGE | SPECIFIC BIT IMAGE |
| NORMAL | CASE C1 | R1 | 3.063KΩ | 10.29KΩ | 3.063KΩ | 10.29KΩ |
| | | | (t ≥102°C) | (t ≥65°C) | (t ≥102°C) | (t ≥65°C) |
| | CASE C2 | R2 | 2.639KΩ | 7.267KΩ | 2.639KΩ | 7.267KΩ |
| | | | (t ≥107°C) | (t ≥75°C) | (t ≥107°C) | (t ≥75°C) |
| | CASE C3 | R3 | 2.418KΩ | 2.639KΩ | 2.418KΩ | 2.639KΩ |
| | | | (t ≥110°C) | (t ≥107°C) | (t ≥110°C) | (t ≥107°C) |
| | PAUSE TIME | K1 | 20% | 40% | 40% | 60% |
| | | K2 | 30% | 50% | 50% | 70% |
| COPY | CASE C1 | R1 | 3.063KΩ | 10.29KΩ | 3.063KΩ | 10.29KΩ |
| | | | (t ≥102°C) | (t ≥65°C) | (t ≥102°C) | (t ≥65°C) |
| | CASE C2 | R2 | 2.639KΩ | 7.267KΩ | 2.639KΩ | 7.267KΩ |
| | | | (t ≥107°C) | (t ≥75°C) | (t ≥107°C) | (t ≥75°C) |
| | CASE C3 | R3 | 2.418KΩ | 2.639KΩ | 2.418KΩ | 2.639KΩ |
| | | | (t ≥110°C) | (t ≥107°C) | (t ≥110°C) | (t ≥107°C) |
| | PAUSE TIME | K1 | 50% | 70% | 70% | 90% |
| | | K2 | 60% | 80% | 80% | 100% |

CASE C0: R≥71.51KΩ(t≤17°C) K=0%

FIG. 11

RECORDING HEAD CONTROL METHOD AND DOT IMPACT PRINTER

BACKGROUND

1. Technical Field

The present invention relates to a method of controlling a recording head that records information by driving recording wires to form dots on recording paper, and to a dot impact printer having the recording head. More particularly, the invention relates to a method of controlling a recording head that can suppress a drop in print throughput while preventing heat damage to the head coil resulting from heat produced while printing, and to a dot impact printer.

The invention claims priority based on Japan patent application 2009-294060 filed Dec. 25, 2009, Japan patent application 2010-133686 filed Jun. 11, 2010, and Japan patent application 2010-133687 filed Jun. 11, 2010, the contents of which are incorporated herein by reference.

2. Related Art

Dot impact printers are used in various fields for the primary purposes of high reliability and overstrike printing on multipart forms. Dot impact printers use a recording head with plural recording wires (wire pins). For each recording wire, the recording head has an electromagnetic coil (head coil) that drives the recording wire, and the recording wires are selectively driven to protrude and form a dot by selectively driving the electromagnetic coils. Dot impact printers have a carriage that carries the recording head, and record information by selectively causing the recording wires of the recording head to strike the recording paper with an ink ribbon therebetween while moving the carriage back and forth widthwise to the recording paper.

When the recording wires of a dot impact printer are driven continuously or at a high frequency, the temperature of the head coils (electromagnetic coils) that are driving those recording wires rises quickly. In extreme cases, the coils may burn out. Therefore, to prevent such problems as the head coils burning out, the temperature of the recording head is detected by a thermistor or other temperature detector so that the heat output of the head coils can be reduced when the temperature rises to a level where there is a danger of heat damage. For example, when the temperature of the recording head reaches a preset slowdown temperature setting, the drive frequency of the head coil is reduced and the printing speed is reduced. When the temperature of the recording head reaches a preset stop-temperature setting, the printing operation of the recording head is stopped. Dot impact printers that thus control operation so that the head coils do not reach a burnout threshold temperature are thus known from the literature. See, for example, Japanese Unexamined Patent Appl. Pub. JP-A-2003-127441.

However, when the head coil temperature rises suddenly, there are situations in which the head coil may exceed the burnout threshold temperature before the temperature detector detects that the head coil has reached the preset temperature and action to reduce the print speed or stop printing can be taken, and the coil cannot be prevented from burning out. To prevent such problems, the dot impact printer described above presets specific dot patterns (specific recording patterns) that can be expected to produce a sudden temperature rise. When a specific recording pattern is detected during printing, the printing is controlled with the slowdown temperature setting and stop-temperature setting set lower than normal. As a result, when the head coil temperature rises rapidly, the printing speed can be lowered or printing stopped before the head coil reaches the burnout threshold temperature.

This dot impact printer changes the slowdown temperature setting and stop-temperature setting to a low temperature even when the specific recording pattern is detected in only one place. As a result, the print speed is reduced or printing is stopped even if the recording head temperature is low enough when the specific recording pattern is printed that the burnout threshold temperature would not be reached by printing the specific recording pattern. More specifically, the dot impact printer described above may reduce the print speed or stop printing even when reducing the print speed or stopping printing is not necessary, and printer throughput therefore drops.

SUMMARY

The present invention is directed to solving at least part of the foregoing problems, and can be achieved by means of the embodiments and applications described below.

A first aspect of the invention is a control method for a recording head of a dot impact printer that prints information on a recording medium by driving the recording wires of a recording head that has a plurality of recording wires while a carriage that carries the recording head traverses the recording medium, each of the recording wires being allocated to printing one dot line in the scanning direction of the carriage, the control method including steps of: during dot line printing, determining before printing if the number of previously defined specific dot patterns contained in the dot line to be printed is greater than or equal to a reference number of 2 or more; and printing the dot line based on the result of the decision.

This aspect of the invention enables setting as a specific dot pattern any pattern that could cause the temperature of the recording head to rise suddenly. Whether or not the number of specific dot patterns in the dot line to be printed exceeds a reference number can then be determined, and the dot line can be printed based on the result of the decision. More specifically, whether or not there is a danger of the recording head temperature exceeding the burnout threshold temperature of the head coil during dot line printing is determined, and the dot line can be printed based on the result of this decision.

Preferably, the recording head control method according to another aspect of the invention includes a step of determining the drive mode of the recording head for printing the dot line based on the decision during dot line printing.

This aspect of the invention determines if the number of specific dot patterns in the dot line to be printed is greater than or equal to a reference number, and selects the drive mode accordingly. More specifically, whether the possibility of a sudden rise in the recording head temperature occurring in the dot line exceeds a reference number is determined, and whether there is a danger of the recording head temperature exceeding the burnout threshold temperature of the head coil when printing the dot line can be determined. As a result, if it is determined that there is a danger of exceeding the burnout threshold temperature of the head coil, printing is accomplished in a drive mode that is set so that burnout does not happen. If it is determined that there is not a danger of exceeding the burnout threshold temperature of the head coil, printing can proceed without changing the drive mode. As a result, a drop in printer throughput can be suppressed while reliably preventing head coil burnout.

A recording head control method according to another aspect of the invention also preferably includes steps of: setting a predetermined number of pattern detection areas of a specified width within the maximum line length of the dot line; and during dot line printing determining before printing if the pattern detection area in the dot line to be printed is a specific area containing the specific dot pattern; determining if the number of specific areas in the dot line is greater than or equal to the reference number; and based on the results of these decisions, determining the drive mode of the recording head for printing the dot line.

This aspect of the invention enables simply determining if a specific dot pattern is contained in a pattern detection area of a specified width, and counting how many specific areas are contained. The processing load can therefore be reduced compared with when the entire dot line is compared with the specific dot pattern.

A recording head control method according to another aspect of the invention also preferably includes steps of: presetting a plurality of drive modes with different heat output as the drive modes of the recording head, and correlating the drive modes with the temperature of the recording head, the temperature of the recording head correlated to each drive mode including at least two temperature settings, a first temperature and a second temperature that is lower than the first temperature; and during dot line printing, detecting the temperature of the recording head before printing, selecting the drive mode corresponding to the detected recording head temperature using the second temperature when the number of specific areas in the dot line to be printed is greater than or equal to the reference number, selecting the drive mode corresponding to the detected recording head temperature using the first temperature when the number of specific areas in the dot line to be printed is less than to the reference number, and printing the dot line using the selected drive mode.

This aspect of the invention enables setting plural recording head temperatures correlated to plural drive modes. As a result, two or more different temperatures can be selectively used based on the number of pattern detection areas containing the specific dot pattern to select the drive mode. As a result, a drop in printer throughput can be suppressed by reliably preventing head coil burnout.

A recording head control method according to another aspect of the invention also preferably includes a step of: when the recording head temperature detected before printing is less than or equal to a preset threshold temperature, determining the drive mode of the recording head without using the result of determining whether or not the pattern detection areas are the specific area.

This aspect of the invention can anticipate that the head coil burnout threshold temperature will not be exceeded even if the specific dot pattern will be printed in plural pattern detection areas, and can prevent a drop in printer throughput.

A recording head control method according to another aspect of the invention also preferably includes steps of: relating the print quality of the print data, and the drive mode of the recording head; and during dot line printing, accomplishing dot line printing using the drive mode selected from among the drive modes related to the print quality of the print data containing the dot line to be printed.

A dot impact printer changes recording head drive control according to the print quality setting. As a result, the temperature increase differs according to the print quality. The control method according to this aspect of the invention enables setting the drive mode according to the print quality. As a result, head coil burnout can be prevented while also suppressing a drop in printer throughput.

A recording head control method according to another aspect of the invention also preferably includes a step of: setting the specific dot pattern based on the number of recording wires driven simultaneously when printing, and a consecutive drive count of a same recording wire.

A dot impact printer has many recording wires that are driven simultaneously, and as the number of times the same recording wires are driven continuously rises, that is, as the dot density rises, the temperature can rise quickly. Based on these parameters, this aspect of the invention can set a specific dot pattern that can be expected to produce a sudden rise in temperature.

A recording head control method according to another aspect of the invention also preferably includes a step of: during dot line printing, determining a rest time in the dot line printing period based on the decision.

This aspect of the invention enables setting as a specific dot pattern any pattern that could cause the temperature of the recording head to rise suddenly. Whether or not the number of specific dot patterns in the dot line to be printed exceeds a reference number can then be determined, and a rest time can be determined for the dot line printing operation.

More specifically, whether the possibility of a sudden rise in the recording head temperature occurring in the printing operation exceeds a reference number is determined, and whether there is a danger of the recording head temperature exceeding the burnout threshold temperature of the head coil when printing the dot line can be determined. As a result, if it is determined that there is a danger of exceeding the burnout threshold temperature of the head coil, printing is accomplished while pausing the printing operation for a rest time that is set so that burnout does not happen. If it is determined that there is not a danger of exceeding the burnout threshold temperature of the head coil, printing can proceed without inserting a rest time. As a result, a drop in printer throughput can be suppressed while reliably preventing head coil burnout.

A recording head control method according to another aspect of the invention also preferably includes steps of: setting a plurality of pattern detection areas of a specific width in an area of the maximum line length of the dot line; and during dot line printing, determining before printing if the pattern detection area in the dot line to be printed is a specific area containing the specific dot pattern, determining if the number of specific areas in the dot line is greater than or equal to the reference number, and based on the results of these decisions, determining the rest time between dot line printing operations.

This aspect of the invention enables simply determining if a specific dot pattern is contained in a pattern detection area of a specified width, and counting how many specific areas are contained. The processing load can therefore be reduced compared with when the entire dot line is compared with the specific dot pattern.

A recording head control method according to another aspect of the invention also preferably includes steps of: presetting a plurality of rest times between dot line printing operations of the recording head, and correlating each rest time to a temperature of the recording head, the recording head temperature correlated to each rest time including at least two temperature settings, a first temperature and a second temperature that is lower than the first temperature; and during dot line printing, detecting the temperature of the recording head before printing, selecting the rest time corresponding to the detected recording head temperature using the second temperature when the number of specific areas in the dot line to be printed is greater than or equal to the reference number; selecting the rest time corresponding to the detected recording head temperature using the first temperature when the number of specific areas in the dot line to be printed is less than to the reference number; and pausing printing during the dot line printing operation based on the selected rest time.

This aspect of the invention enables setting plural recording head temperatures correlated to plural rest times. As a result, two or more different temperatures can be selectively used based on the number of pattern detection areas containing the specific dot pattern to select the rest time. As a result, a drop in printer throughput can be suppressed by reliably preventing head coil burnout.

A recording head control method according to another aspect of the invention also preferably includes a step of, when the recording head temperature detected before printing is less than or equal to a preset threshold temperature, determining the rest time of the recording head without using the result of determining whether or not the pattern detection areas are the specific area.

This aspect of the invention can anticipate that the head coil burnout threshold temperature will not be exceeded even if the specific dot pattern will be printed in plural pattern detection areas, and can prevent a drop in printer throughput.

A recording head control method according to another aspect of the invention also preferably includes steps of: relating the print quality of the print data, and the rest time of the recording head; and during dot line printing, pausing printing during the dot line printing operation for the rest time selected from among the rest times related to the print quality of the print data containing the dot line to be printed.

A dot impact printer changes recording head drive control according to the print quality setting. As a result, the temperature increase differs according to the print quality. The control method according to this aspect of the invention enables setting the rest time according to the print quality. As a result, head coil burnout can be prevented while also suppressing a drop in printer throughput.

Another aspect of the invention is a dot impact printer including a carriage that scans a direction substantially perpendicular to the feed direction of a recording medium on which information is printed; a recording head that is carried on the carriage and has a plurality of recording wires that form print dot rows in a dot line; and a control unit that controls the recording head, determines before printing each dot line if the number of previously defined specific dot patterns contained in the dot line to be printed is greater than or equal to a reference number of 2 or more, and prints the dot line based on the result of the decision.

A dot impact printer according to this aspect of the invention can set as a specific dot pattern any pattern that could cause the temperature of the recording head to rise suddenly. Whether or not the number of specific dot patterns in the dot line to be printed exceeds a reference number can then be determined, and the dot line can be printed based on the result of the decision.

In a dot impact printer according to another aspect of the invention, the control unit, based on the decision, determines the drive mode of the recording head for printing the dot line.

The dot impact printer according to this aspect of the invention determines if the number of specific dot patterns in the dot line to be printed is greater than or equal to a reference number, and selects the drive mode accordingly. More specifically, whether the possibility of a sudden rise in the recording head temperature occurring in the dot line exceeds a reference number is determined, and whether there is a danger of the recording head temperature exceeding the burnout threshold temperature of the head coil when printing the dot line can be determined. As a result, if it is determined that there is a danger of exceeding the burnout threshold temperature of the head coil, printing is accomplished in a drive mode that is set so that burnout does not happen. If it is determined that there is not a danger of exceeding the burnout threshold temperature of the head coil, printing can proceed without changing the drive mode. As a result, a drop in printer throughput can be suppressed while reliably preventing head coil burnout.

In a dot impact printer according to another aspect of the invention, the control unit, based on the decision, determines a rest time for the recording head, and pauses printing during the dot line printing operation.

The dot impact printer according to this aspect of the invention can set as a specific dot pattern any pattern that could cause the temperature of the recording head to rise suddenly. Whether or not the number of specific dot patterns in the dot line to be printed exceeds a reference number can then be determined, and a rest time can be determined for the dot line printing operation.

More specifically, whether the possibility of a sudden rise in the recording head temperature occurring in the printing operation exceeds a reference number is determined, and whether there is a danger of the recording head temperature exceeding the burnout threshold temperature of the head coil when printing the dot line can be determined. As a result, if it is determined that there is a danger of exceeding the burnout threshold temperature of the head coil, printing is accomplished while pausing the printing operation for a rest time that is set so that burnout does not happen. If it is determined that there is not a danger of exceeding the burnout threshold temperature of the head coil, printing can proceed without inserting a rest time. As a result, a drop in printer throughput can be suppressed while reliably preventing head coil burnout.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 8 is a control table used to determine the drive mode in the first embodiment of the invention.

FIG. 11 is a control table for determining the carriage drive pause time in the second embodiment of the invention.

DESCRIPTION OF EMBODIMENTS

Embodiment 1

A first embodiment of the invention is described below with reference to the accompanying figures. Note that for convenience of description or illustration in the figures referenced below, the scale of the horizontal and vertical dimensions of selected members or portions thereof may be shown differently from the actual scale.

Configuration of a Dot Impact Printer

Figure 1:
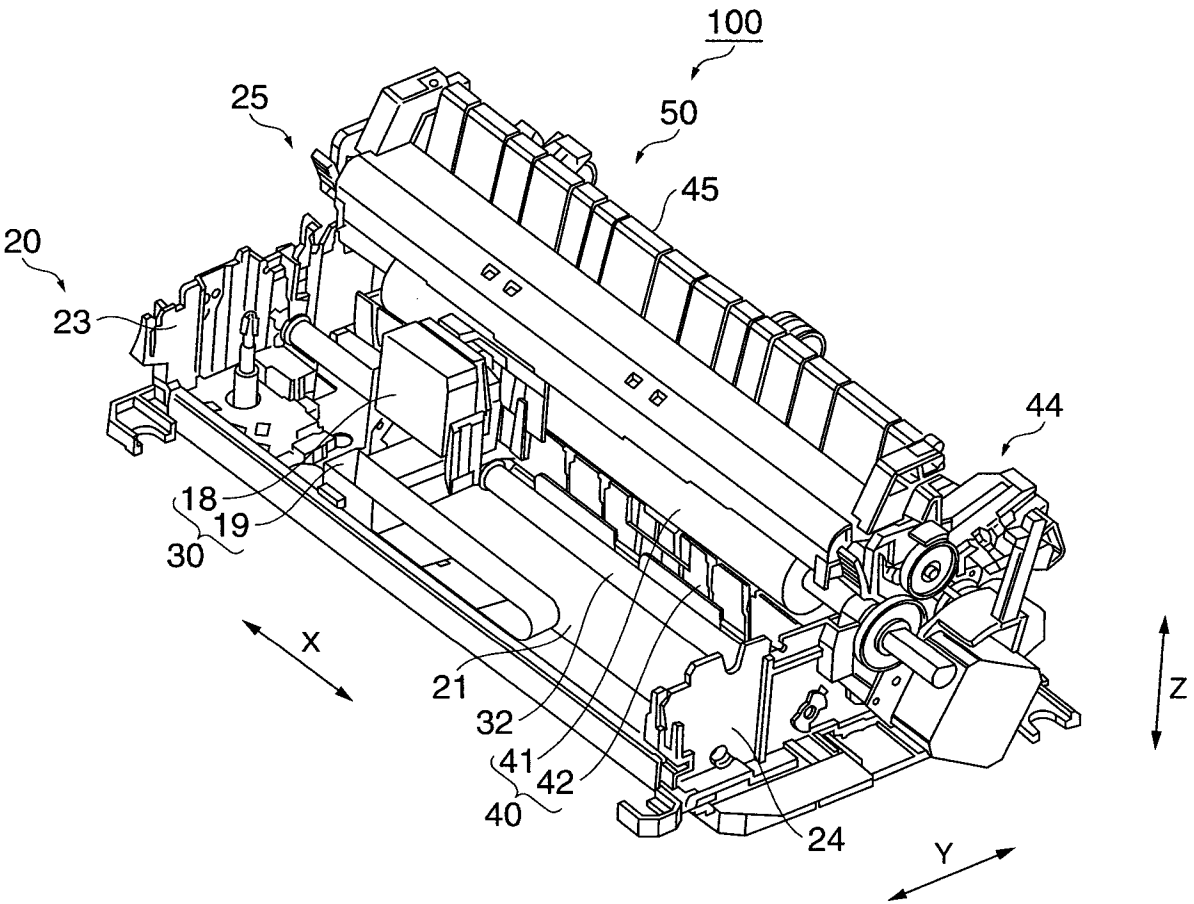
FIG. 1 is an oblique view of the print assembly of a dot impact printer according to a preferred embodiment of the invention.
Figure 2:
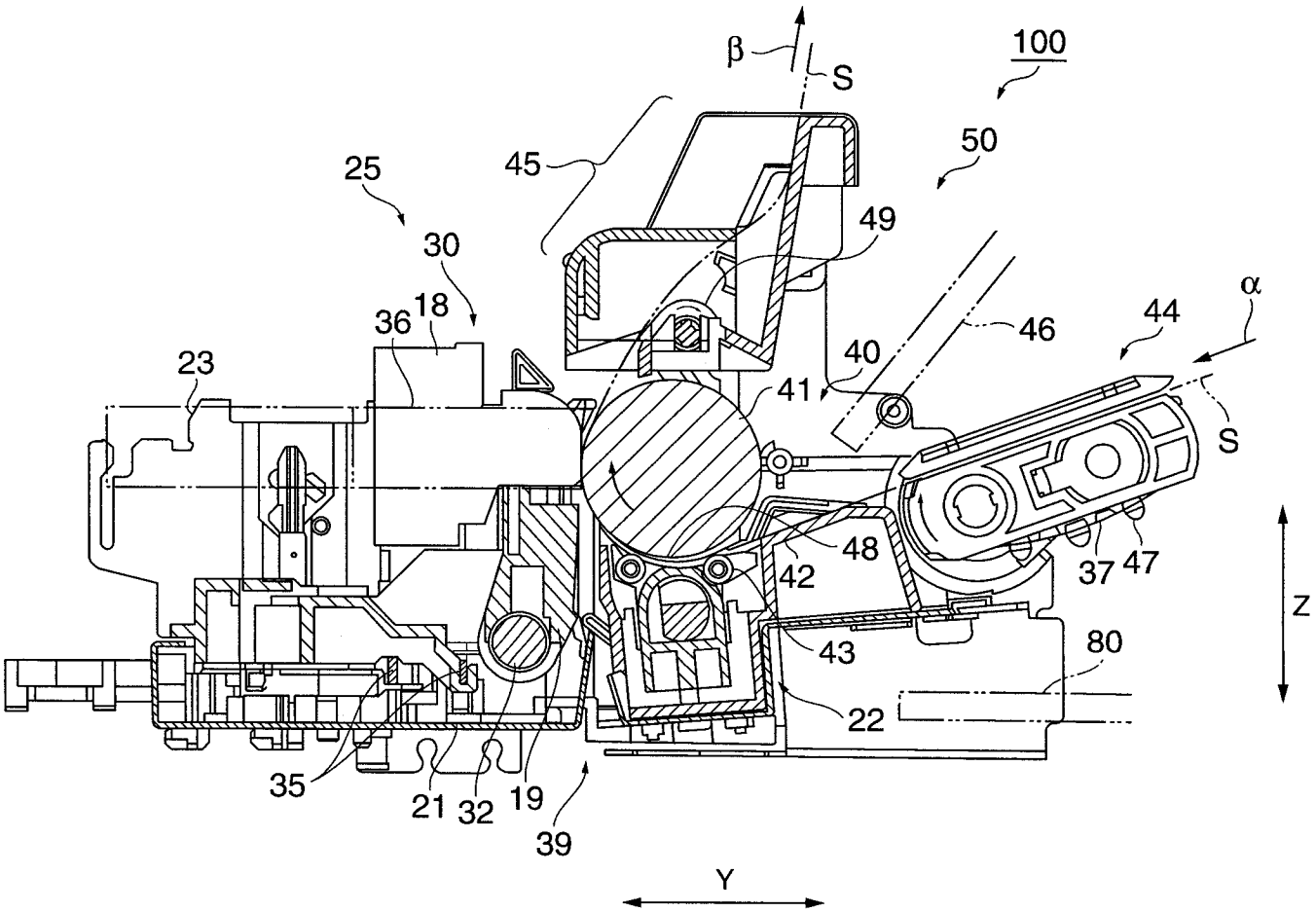
FIG. 2 is a side section view of the print assembly of the dot impact printer.

A dot impact printer that uses a recording head according to this embodiment of the invention is described below with reference to FIG. 1 and FIG. 2. FIG. 1 is an oblique view of the print assembly used in the dot impact printer, and FIG. 2 is a side section view of the print assembly. Note that the x-axis shown in FIG. 1 and FIG. 2 is the direction of the width of the recording paper that is printed, that is, the direction in which the carriage moves; the y-axis is the direction in which the recording wires of the recording head carried on the carriage move and protrude; and the z-axis is perpendicular to the x-axis and the y-axis.

Dot impact printers are used in the sales and distribution industries, for example, and have a recording head that is carried on a carriage that travels across a platen. While the recording head is moved widthwise across the platen, recording wires (pins) that are part of the recording head are driven to strike the recording paper positioned in front of the platen with an ink ribbon between the recording head and the paper, thereby recording information such as text and images onto the recording paper. The recording paper as used herein includes single slips or continuous paper, which may be plain paper or multipart forms paper, passbooks, and envelopes.

As shown in FIG. 1 and FIG. 2, the dot impact printer 100 includes at least a print assembly 50 having a frame 20, a print mechanism 30, and a paper feed mechanism 40; a control device 80; and an external case not shown that covers these.

The frame 20 includes at least a base frame 21 as the main frame, a paper guide frame 22, a left side frame 23, and a right side frame 24.

Figure 5:
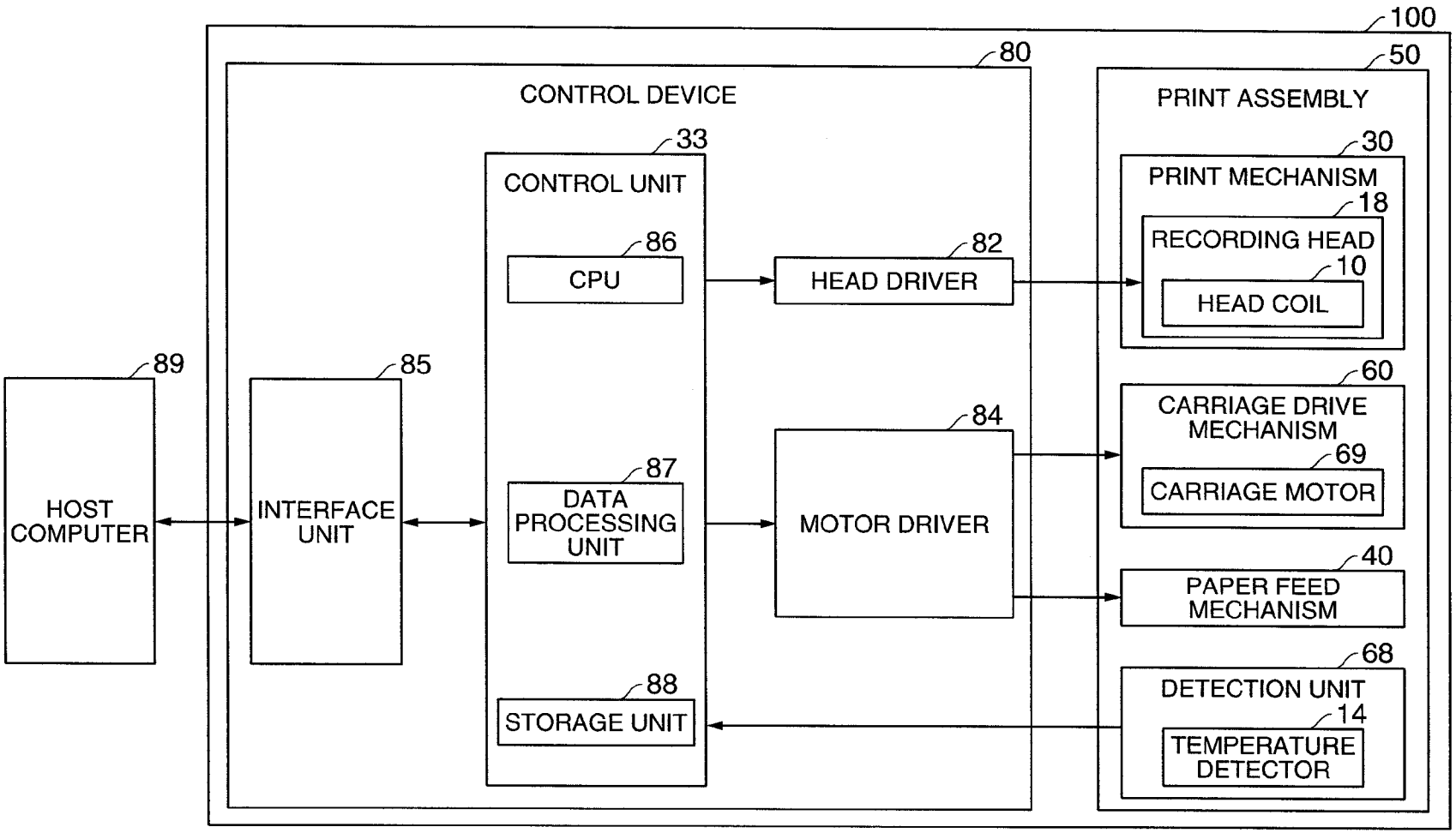
FIG. 5 is a block diagram of the printing control system of the dot impact printer.

The print mechanism 30 includes at least a recording head 18, a carriage 19 on which the recording head 18 is mounted, and a carriage drive mechanism 60 (FIG. 5).

The paper feed mechanism 40 includes a platen 41, a paper guide 42, a pinch roller 43, a push tractor unit 44, a discharge unit 45, and a paper supply guide 46.

As shown in FIG. 1, the left side frame 23 and right side frame 24 are disposed vertically to opposite ends of the frame 20, and the base frame 21 and paper guide frame 22 (see FIG. 2) are disposed between the left side frame 23 and right side frame 24. A carriage guide shaft 32 and the platen 41 are disposed freely rotatably between the left side frame 23 and right side frame 24. The paper guide 42 is fit and fastened to the paper guide frame 22 between the left side frame 23 and right side frame 24. A tractor unit installation unit and discharge unit installation unit not shown to which the push tractor unit 44 and discharge unit 45 can be installed are disposed to the left side frame 23 and right side frame 24 at the back on the y-axis.

The push tractor unit 44 feeds continuous-feed paper used as the recording paper S to the paper feed mechanism 40. The paper supply guide 46 (FIG. 2) feeds slips used as the recording paper S one sheet (one page) at a time to the paper feed mechanism 40. The discharge unit 45 discharges the recording paper S, whether continuous-feed paper or slip media, from the paper feed mechanism 40 to the outside of the dot impact printer 100. As shown in FIG. 2, continuous-feed paper is guided to the paper guide 42 of the paper feed mechanism 40 by the action of the pins 47 of a tractor belt 37 when the tractor belt 37 of the push tractor unit 44 turns. The continuous-feed paper then travels through a paper feed path 48 formed between the paper guide 42 and platen 41 to the front of the platen 41 on the y-axis, and is supplied in the direction of arrow (shown in FIG. 2.

When the push tractor unit 44 is not operating, slips can be supplied one sheet (one page) at a time from the paper supply guide 46 through the paper feed path 48 to the front of the platen 41. The continuous-feed paper or slip on which text or other content is recorded by the recording head 18 is pulled from the platen 41 part of the paper feed mechanism 40 in the direction of arrow β by rotation of the discharge roller 49 of the discharge unit 45 as described further below. As a result, the continuous-feed paper or slip is conveyed along the y-axis (subscan direction) perpendicular to the x-axis (main scan direction) of the carriage 19.

The carriage 19 shown in FIG. 1 is fit to slide freely along the carriage guide shaft 32 and carries the recording head 18. Because the carriage guide shaft 32 and platen 41 are parallel, the carriage 19 can move (scan) on the x-axis aligned with the axes of the platen 41 and the carriage guide shaft 32. Forward or reverse rotation of a carriage drive motor not shown causes the carriage 19 to move bidirectionally on the x-axis guided on the carriage guide shaft 32 by means of an intervening timing belt 35 (FIG. 2).

The recording head 18 has a plurality of recording wires 9 (see FIG. 3), and an ink ribbon 36 (FIG. 2) is positioned in front of the recording wires 9 in the direction in which the recording wires 9 protrude (the y-axis). The recording head 18 causes the recording wires 9 to protrude in a specific printable area that is within the range of carriage 19 movement on the x-axis. By causing the recording wires 9 to strike the ink ribbon 36, ink contained in the ink ribbon 36 is transferred to the recording paper S (continuous-feed paper or slip) conveyed between the platen 41 and ink ribbon 36, thereby forming dots on the recording paper S.

A single line is recorded by means of plural recording wires 9 on the recording head 18 while the carriage 19 travels left or right on the x-axis. Each time one line is recorded, the platen 41, push tractor unit 44, and discharge unit 45 of the paper feed mechanism 40 shown in FIG. 2 convey the recording paper S a specific distance (normally the line pitch). The recording paper S is normally advanced when the carriage 19 is positioned in a standby zone outside the specific printable area of the range of movement on the x-axis. The recording operation of the recording head 18 is accomplished by repeating these operations.

Note that the dot impact printer 100 also has a bottom paper feed opening 39 rendered between the base frame 21 and the paper guide frame 22 for supplying the recording paper S to the paper feed mechanism 40 from the bottom on the z-axis shown in FIG. 2.

Note also that driving the paper feed mechanism 40, carriage drive mechanism 60, and print mechanism 30 that perform the foregoing tasks is controlled by the control device 80. This control device 80 is rendered on a circuit board, for example, and is disposed, for example, behind the print assembly 50 on the y-axis and below the paper guide frame 22 on the z-axis. The control device 80 is described in detail below.

Recording Head

Figure 3:
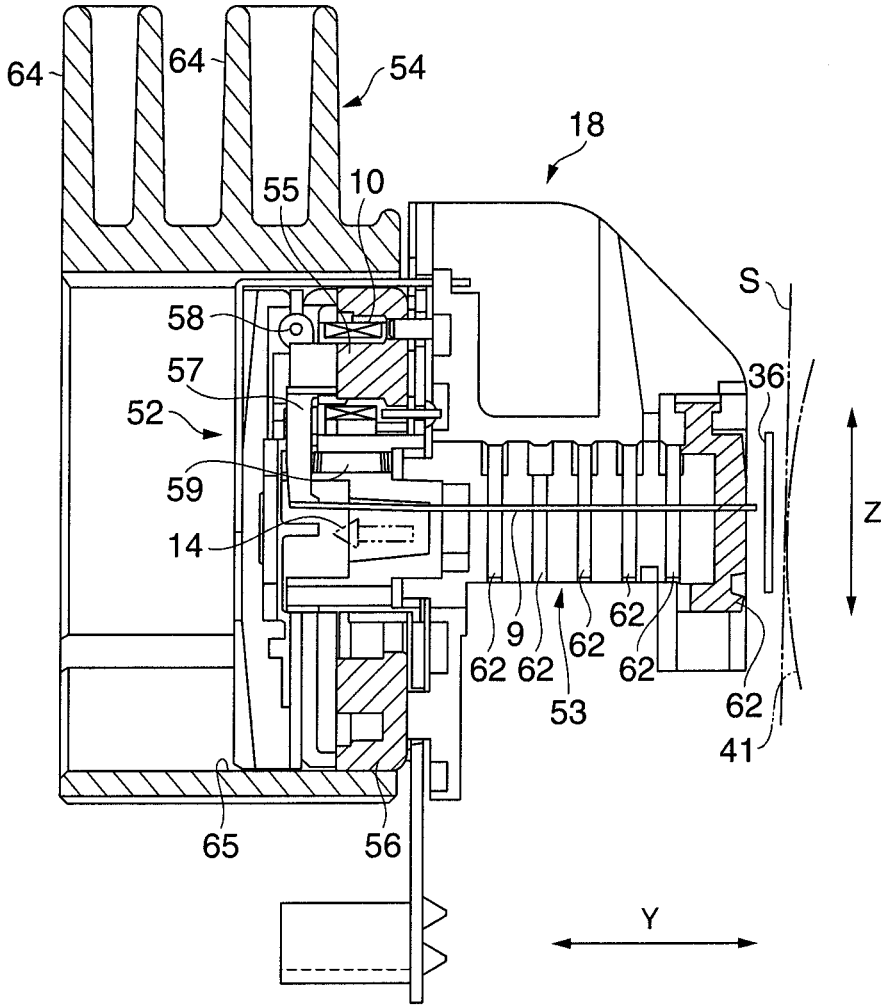
FIG. 3 is a section view of the recording head.
Figure 4:
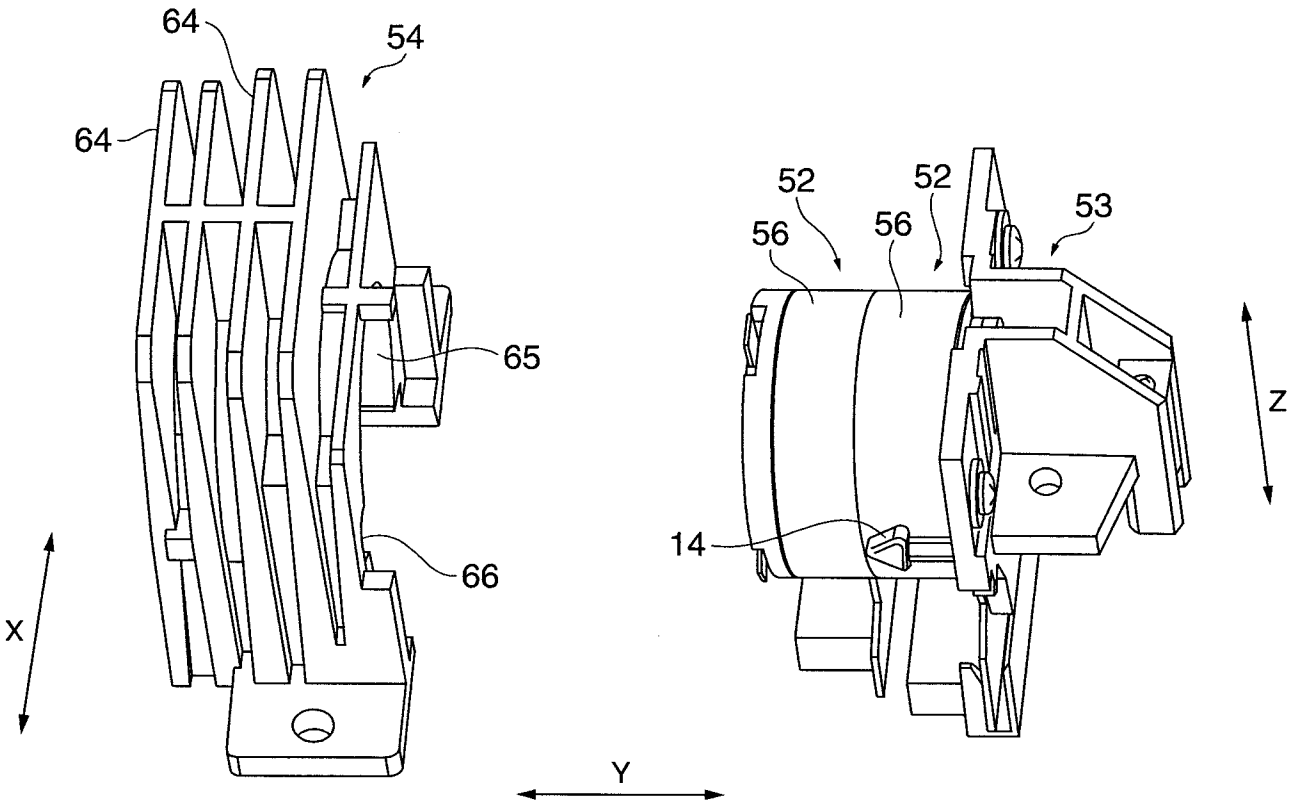
FIG. 4 is an exploded view of the recording head.

The recording head is described next with reference to FIG. 3 and FIG. 4. FIG. 3 is a section view of the recording head, and FIG. 4 is an exploded oblique view of the recording head. Note also that the x-axis, y-axis, and z-axis shown in FIG. 3 and FIG. 4 are the same as the x-axis, y-axis, and z-axis shown in FIG. 1 and FIG. 2.

As shown in FIG. 3 and FIG. 4, the recording head 18 is a serial dot head, and includes a plurality of recording wires 9, a plurality of head coils (electromagnetic coils) 10, a head housing 52 housing these, a nose 53, a heat sink 54, and a temperature detector (thermistor) 14.

The recording head 18 is configured with the nose 53 contiguous to the head housing 52 on the y-axis in FIG. 3, and the heat sink 54 on the outside of the head housing 52. The recording wires 9 are formed from wire pins that are round in section view, and the face of one recording wire 9 forms one dot. As a result, there may be 9 pins, 16 pins, or 24 pins, for example, according to the dot configuration (dot density) recorded by the recording head 18. In addition, there is usually one head coil 10 disposed for one recording wire 9.

As shown in FIG. 3, the head housing 52 includes a frame 56 that houses the plural recording wires 9 and head coils 10, and a wire lever 57 and reset spring 59. The frame 56 is cylindrically shaped, and has plural cores 55 to which the head coils 10 are wound disposed with a specific interval therebetween around the circumference. A recording wire 9 is connected to one end of the wire lever 57, and when the head coil 10 is energized, the wire lever 57 is pulled to the core 55 and driven. The reset spring 59 urges the wire lever 57 in the direction away from the core 55 pivoting on a pin 58. With this configuration, the recording wire 9 protrudes to the outside on the y-axis from the nose 53 when the wire lever 57 is pulled to the core 55. Two head housings 52 are stacked together on the y-axis, which is the direction in which the recording wires 9 advance and retract, and rendered as an integral head housing. Only one head housing 52 is shown in FIG. 3, however.

The nose 53 guides the in/out operation, including the protruding operation, of the recording wires 9, and includes a plurality of intermediate guides 62 disposed internally, and a single front guide 63 disposed at the distal end of the nose 53. The plural recording wires 9 are guided to advance and retract passing through these intermediate guides 62 and the front guide 63. Note that the plural recording wires 9 are disposed in a line or zigzag pattern along the z-axis in the front guide 63 of the nose 53. Note, further, that only one recording wire 9 is shown passing through the intermediate guides 62 and front guide 63 in FIG. 3, and the other recording wires 9 are omitted.

As shown in FIG. 3 and FIG. 4, the heat sink 54 is made from a material with good thermal conductivity, such as aluminum, and is formed in a cylindrical shape with a plurality of fins 64 formed in unison on the outside. The heat sink 54 is rendered around the outside of the head housings 52 of the integral head housing covering each of the head housings 52. The head coils 10 of the head housings 52 become heat elements and produce heat during the printing operation, that is, when energized. The heat sink 54 dissipates the heat of the head housings 52 produced by heat from the head coils 10 using the fins 64, and thus functions to cool the head housings 52.

As shown in FIG. 4, a temperature detector 14 (thermistor) that detects the temperature of the frame 56 of the head housing 52 is disposed on the outside of the frame 56 of one head housing 52 of the integral head housing. The temperature detector 14 is housed in a channel 66 formed in the inside surface 65 of the heat sink 54 when the heat sink 54 is installed to the head housings 52 of the integral head housing. The temperature detector 14 detects the temperature of the frame 56 of the head housing 52 and outputs to the control device 80.

Note that because the recording head 18 is thus rendered, the temperature of the head coils 10 is higher than the temperature of the frame 56. As a result, the temperature of the head coils 10, or more specifically the heat output, is controlled based on a predetermined correlation between the temperature of the head coils 10 and the temperature of the frame 56.

Controlling the Dot Impact Printer

The control system of the dot impact printer is described next with reference to FIG. 5. FIG. 5 is a block diagram showing the main components of the dot impact printer. As shown in FIG. 5, the dot impact printer 100 includes a print assembly 50 and a control device 80 that controls the print assembly 50. The print assembly 50 includes a print mechanism 30 including the recording head 18, a carriage drive mechanism 60 including a carriage motor not shown, the paper feed mechanism 40, and a detection unit 68 including the temperature detector 14 (thermistor).

The control device 80 includes a control unit 33 that is the main part of the control system, a head driver 82 that controls driving the recording head 18, a motor driver 84 that drives the paper feed mechanism 40 and carriage drive mechanism 60, and an interface unit 85. The control unit 33 includes a CPU 86 (central processing unit), data processing unit 87, and storage unit 88. The CPU 86 executes various processes, including processing input signals from other operating channels and detection channels not shown, and the printing process. The data processing unit 87 processes various types of information.

The storage unit 88 includes RAM (random access memory) and ROM (read-only memory) not shown. RAM is used for temporarily storing print data and other data input from the host computer 89 through the interface unit 85, and temporarily storing programs such as a printing process executed by the CPU 86. The print data specifies the pattern to be printed on the recording paper S by the recording head 18.

Based on a command from the CPU 86, the head driver 82 controls the recording wires 9 of the recording head 18 individually or in groups. The method of controlling the recording head 18 is described below.

The motor driver 84 individually controls the motors of the paper feed mechanism 40 and carriage drive mechanism 60 based on commands from the CPU 86.

The interface unit 85 outputs print data received from the host computer 89 to the control unit 33, and outputs information received from the control unit 33 to the host computer 89.

Recording Head Control Method of the First Embodiment

Figure 6:
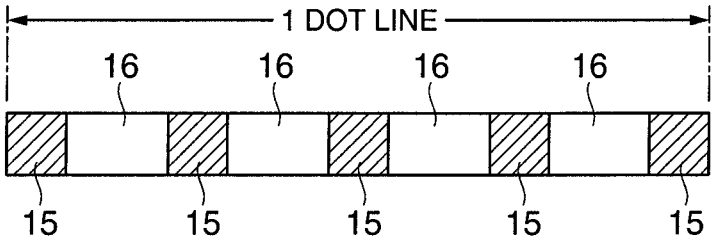
FIG. 6 shows the distribution of pattern detection areas on each dot line in a first embodiment of the invention.
Figure 7A:
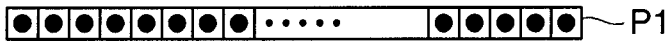
FIG. 7 describes a specific bit image (specific dot pattern) used to determine the drive mode.
Figure 7B:
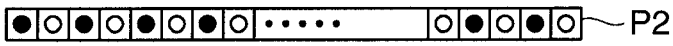

The recording head control method of the first embodiment of the invention is described next with reference to FIG. 5 to FIG. 8. FIG. 6 shows the distribution of pattern detection areas in each dot line in the first embodiment of the invention. FIG. 7 describes a specific bit image as an example of a specific dot pattern that is used to determine the drive mode, FIG. 7A showing a first dot pattern that is formed by a single recording wire continuously forming 50 dots, and FIG. 7B showing a second dot pattern that is formed by a single recording wire forming 25 dots in the space of 50 continuous dots by skipping every other dot. FIG. 8 is a control table for determining the drive mode in the first embodiment of the invention.

The control unit 33 shown in FIG. 5 outputs a control signal through the head driver 82 to each of the head coils 10 of the recording head 18 based on the print data and control commands, and controls energizing each of the head coils 10.

Detection signals from the temperature detector 14 disposed to the frame 56 of the recording head 18 shown in FIG. 3 and FIG. 4 are input to the control unit 33. During printing, the control unit 33 determines based on the detection signal from the temperature detector 14 if the recording head 18 has exceeded a preset threshold temperature. Based on the result of this decision, the control unit 33 determines the drive mode of the recording head 18 during printing, that is, sets the energizing control mode of the head coils 10 that drive the recording wires 9. The storage unit 88 of the control unit 33 stores data used to determine the drive mode and for controlling each drive mode.

In this embodiment of the invention as shown in FIG. 6 for example, if one dot line is a maximum 136 columns wide (one column being the width of one character), five pattern detection areas 15 are set within the range of the maximum column count of one dot line. More specifically, the pattern detection areas 15 are distributed so that a pattern detection area 15 is set at the left and right ends of the 136 columns and the remaining three pattern detection areas 15 are distributed evenly between the end pattern detection areas 15. If the width of each pattern detection area is 8 columns, the width of the non-detection area 16 between neighboring pattern detection areas 15 is 24 columns. Note the dot line shown in FIG. 6 is recorded by one recording wire 9 of the recording head 18.

As shown in FIG. 7A and FIG. 7B, the first dot pattern P1 used as a specific bit image is formed by any same recording wire 9 continuously recording 50 dots, for example, and the second dot pattern P2 is formed by any same recording wire 9 recording, for example, 25 dots every other dot in the same length as the continuously recorded 50 dots. Before printing each dot line, the control unit 33 determines if either the first dot pattern P1 or the second dot pattern P2 is contained in each of the five pattern detection areas 15 of the dot line to be printed. The number of pattern detection areas 15 (specific areas) containing either the first dot pattern P1 or the second dot pattern P2 in the dot line to be printed is also counted, and whether this count is greater than or equal to a preset reference number N, or is less than the reference number N, is determined. Based on the result of this decision, the control unit 33 then determines the drive mode of the recording head 18 when printing that dot line. In this embodiment of the invention any of the numbers 2, 3, 4, and 5 can be set as this reference number N.

The control table for determining the drive mode shown in FIG. 8 is described next. In addition to the number of specific areas described above, the parameters for determining the drive mode of the recording head 18 in this embodiment of the invention include the print quality setting specified for the print data containing the dot line to be printed. The print quality is specified by the combination of two parameters, the print mode and the character quality. Either a normal or a copy mode is specified as the print mode. The character quality can be set to either draft or letter quality (LQ). The draft mode is set for print data with a lower resolution than a preset reference resolution. The LQ mode is set for print data with resolution at least equal to the reference resolution.

As described above, this embodiment of the invention determines based on the detection signal from the temperature detector 14 if the temperature of the recording head 18 exceeds a preset threshold temperature, and based on the result of this decision adjusts how the head coils 10 are energized when printing each dot line. For example, this embodiment of the invention uses three different threshold temperatures as the threshold temperature. In the control table shown in FIG. 8, the values shown in the columns labelled "specific bit image" are used when the number of specific areas is greater than or equal to the reference number N, and the values in columns labelled "not-specific bit image" are used when the number of specific areas is less than the reference number N. As shown in the control table, each of the four print quality settings rendered by two print mode and character quality settings is divided into two cases, that is, whether the number of specific areas is greater than or equal to the reference number N (specific bit image), and whether the number of specific areas is less than the reference number N (not-specific bit image), resulting in 8 patterns for which three different threshold temperature settings are preset.

In addition to the set threshold temperatures, the control table also shows the output values of the temperature detector 14 at each threshold temperature, that is, the output values of the thermistor. As shown in FIG. 8, the three threshold temperature settings each have two levels, a setting (second temperature) for when the number of specific areas is greater than or equal to the reference number N, and a setting (first temperature) for when the number of specific areas is less than the reference number N.

Of the three threshold temperatures, the lowest threshold temperature is the print interval condition for setting the time interval from when energizing to form one dot is completed to when energizing to form the next dot starts (the head coil drive interval or non-printing time). The output of the temperature detector 14 at this threshold temperature is Rin. The control unit 33 compares the temperature detector 14 output with Rin to determine whether to use the initial interval (Tin1) or the high temperature interval (Tin2). In this embodiment of the invention the temperatures used as Tin1 and Tin2 differ according to the print quality setting, and the values of Tin1 and Tin2 for each print quality setting differ as shown in the control table in FIG. 8.

The next lowest threshold temperature is the unidirectional (Uni-D) print condition for setting whether to print in the bidirectional print mode in which dots are formed on both the outbound and return passes of the carriage 19 on the x-axis shown in FIG. 1, or to print in the unidirectional print mode in which dots are formed only on the outbound pass or the return pass. The output of the temperature detector 14 for this threshold temperature is Rhh. The control unit 33 compares the temperature detector 14 output with Rhh to determine whether to operate in the bidirectional print mode or unidirectional print mode.

The highest threshold temperature is the stop printing condition that is used to determine whether or not to stop printing. The output of the temperature detector 14 corresponding to this threshold temperature is Rst.

Printing Process

Figure 9:
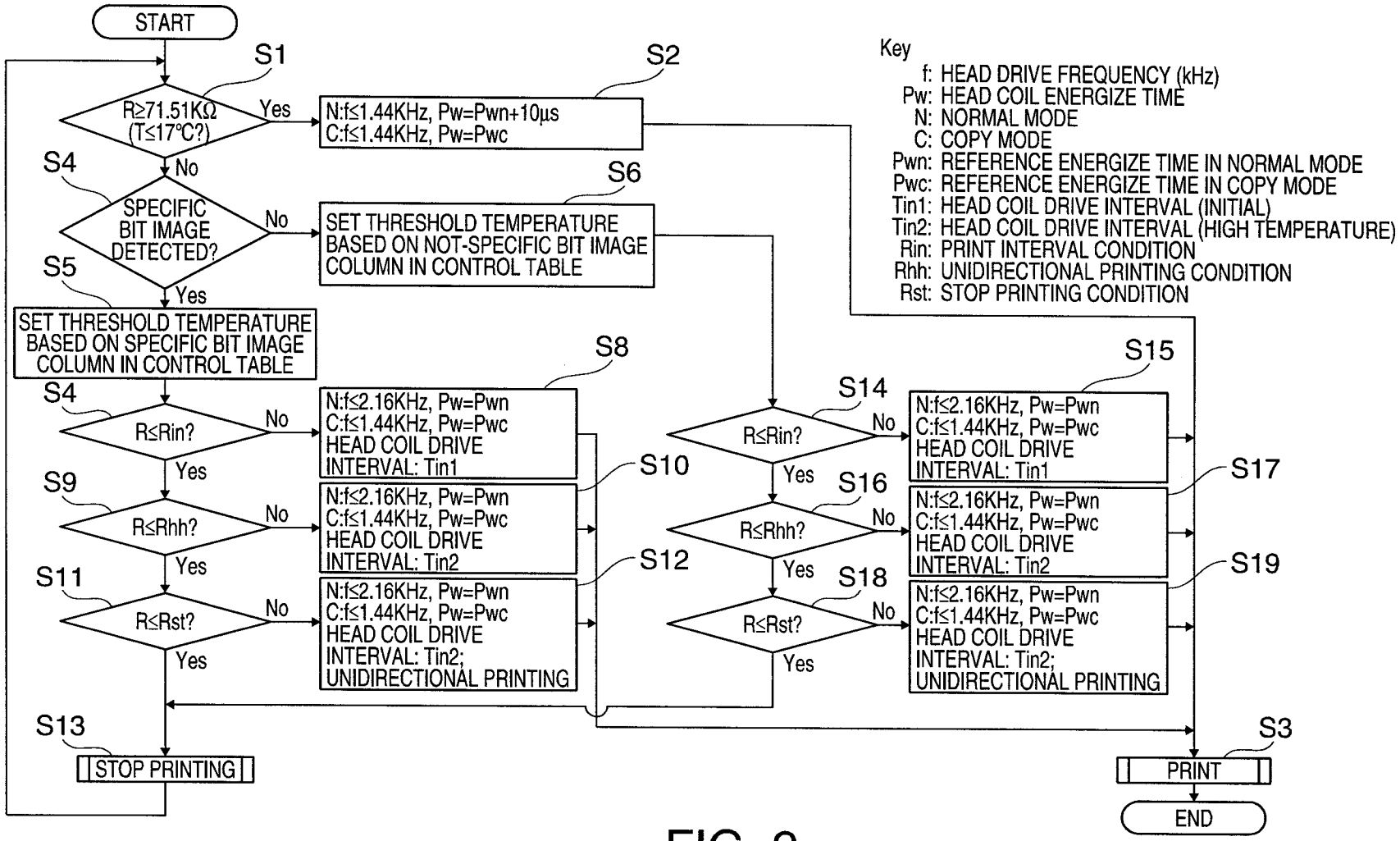
FIG. 9 is a flow chart describing the printing process in the first embodiment of the invention.

The dot line printing process according to the first embodiment of the invention is described next with reference to FIG. 9. FIG. 9 is a flow chart of the process for printing each dot line using the control table.

In step S1 in FIG. 9 the control unit 33 detects the output value R of the temperature detector 14 and compares it with the output value corresponding to the preset threshold temperature. The threshold temperature that is used in this step is an even lower value than the print interval condition, which is the lowest temperature of the three threshold temperatures described above, and in this embodiment is set to 17° C. (the corresponding output value of the temperature detector 14 is 71.51 kΩ). If the temperature of the recording head 18 is less than or equal to the threshold temperature, that is, if R≥71.51 kΩ (step S1 returns Yes), the temperature of the recording head 18 is determined to be sufficiently low and control goes to step S2.

The drive mode is set under these conditions in step S2. The control unit 33 sets the head coil drive frequency f to 1.44 kHz, for example, and sets the head coil energize time Pw to Pwn+10 μs in the normal mode, and to Pwc in the copy mode.

The head coil drive frequency f is the frequency of the pulse voltage applied to the head coils 10 of the recording head 18, and means the maximum number of times the recording wire 9 is driven to protrude per unit time (the maximum protrusion operation count).

Pwn is the preset reference energize time in the normal mode, and Pwc is the preset reference energize time in the copy mode. Note that the initial interval (Tin1) corresponding to the print quality can be selected from among the values in the not-specific bit image column for the head coil drive interval. Alternatively, a different interval value may be set. Control then goes to step S3.

In step S3 the dot line to be printed is printed in the drive mode using the parameters set in step S2. The process then ends.

If in step S1 in FIG. 9 the temperature T of the recording head 18 exceeds the threshold temperature (step S1 returns No), control goes to step S4.

The control unit 33 detects and evaluates a specific bit image in step S4. More particularly, the control unit 33 detects if the specific bit image (first dot pattern P1 or second dot pattern P2) is found in the five pattern detection areas 15 shown in FIG. 6, and compares the number detected with the reference number N. If the number of pattern detection areas 15 (specific areas) in which a specific bit image is found is greater than or equal to N (step S4 returns Yes), control goes to step S5.

In step S5 the control unit 33 references the control table in FIG. 8, and selects the temperatures in the specific bit image column of the print quality specified for the current print data as the three threshold temperatures. The control unit 33 then sets the output values Rin, Rhh, Rst corresponding to the selected threshold temperatures as the criteria to be used to set the drive mode.

If in step S4 the number of pattern detection areas 15 in which the specific bit image was found is less than N (step S4 returns No), control goes to step S6.

In step S6 the control unit 33 references the control table in FIG. 8, and selects the temperatures in the not-specific bit image column of the print quality specified for the current print data as the three threshold temperatures. The control unit 33 then sets the output values Rin, Rhh, Rst corresponding to the selected threshold temperatures as the criteria to be used to set the drive mode.

If control goes to step S5 as a result of the decision from step S4 in FIG. 9, the output value R of the temperature detector 14 is compared with Rin, Rhh, Rst in steps S7 to S12, and the drive mode is set based on the results of these steps. The three threshold temperatures (second temperature) set in step S5 at this time are 65° C., 75° C., 107° C.

In step S7 the output R of the temperature detector 14 is first compared with output Rin corresponding to the print interval condition (65° C.) that is the lowest threshold temperature. If R>Rin (recording head 18 temperature T<65° C.) (step S7:No), control goes to step S8, and the head coil drive frequency f, and head coil energize time Pw are set to the values corresponding to the current print quality. The head coil drive interval at this time is set to Tin1. Control then goes to step S3, the dot line to be printed is printed using the parameters set in step S8, and the process ends.

However, if in step S7 R≤Rin (recording head 18 temperature T≥65° C.) (step S7:Yes), control goes to step S9, and the output R of the temperature detector 14 is compared with output value Rhh corresponding to the unidirectional printing condition (75° C.). If R>Rhh (recording head 18 temperature T<75° C.) (step S9:No), control goes to step S10, and the head coil drive frequency f and head coil energize time Pw are set to the values corresponding to the current print quality. The head coil drive interval at this time is set to Tin2. Control then goes to step S3, the dot line to be printed is printed using the parameters set in step S10, and the process ends.

If in step S9 R≤Rhh (recording head 18 temperature T≥75° C.) (step S9:Yes), control goes to step S11 and the output R of the temperature detector 14 is compared with output value Rst corresponding to the stop printing condition (107° C.). If R>Rst (recording head 18 temperature T<107° C.) (step S11: No), control goes to step S12, and the head coil drive frequency f and head coil energize time Pw are set to the values corresponding to the current print quality. The head coil drive interval at this time is set to Tin2. Control then goes to step S3, the dot line to be printed is printed using the parameters set in step S12, and the process ends.

However, if in step S11 R≤Rst (107° C.) (step S11:Yes), control goes to step S13 and printing stops for a preset delay time (a time sufficient for the recording head 18 to cool). Control then goes to to step S1 and processing resumes.

If control goes to step S6 as a result of step S4 in FIG. 9, the temperature R of the recording head 18 is compared with threshold temperatures Rin, Rhh, Rst in steps S14 to S19, and the drive mode is set based on the results of these steps.

In step S6 the threshold temperatures Rin, Rhh, Rst (first temperature) are 102° C., 107° C., 110° C., respectively. Steps S14 to S19 are the same as steps S7 to S12 except that the three threshold temperatures are higher than the threshold temperatures used in steps S7 to S12.

Note that the drive mode settings in steps S8, S10, and S12 are the same as the settings in steps S15, S17, and S19, respectively. More specifically, in this embodiment as shown in FIG. 8 and FIG. 9, the threshold temperatures of the recording head 18 for changing the drive mode to the settings shown in step S8, S10, S12 are lower in the case of a specific bit image than in the case of a not-specific bit image, and in the case of a specific bit image, the drive mode is configured to produce less heat even if the recording head 18 temperature is the same.

The effect of the first embodiment of the invention is described below.

As described above, the pattern detection areas 15 in the dot line to be printed are compared with a specific bit image in this embodiment of the invention. If the number of pattern detection areas 15 containing the specific bit image is greater than or equal to a reference number N, the threshold temperature of the recording head 18 used to change to a drive mode that produces less heat and has a slower print speed is set to a low temperature (second temperature). If less than the reference number N, however, the threshold temperature of the recording head 18 used to change to a drive mode that produces less heat and has a slower print speed is set to a higher temperature (first temperature) than the second temperature. As a result, the recording head 18 drive mode does not change to a drive mode that produces less heat and has a slow print speed when the number of pattern detection areas 15 containing the specific bit image is 1 or less and the temperature of the recording head 18 is anticipated to not exceed the burnout threshold temperature of the head coil 10. Burnout of the head coil 10 can therefore be prevented and a drop in printer throughput can be suppressed.

Embodiment 2

A second embodiment of the invention is described next with reference to accompanying figures. Note that parts and content of the second embodiment that are the same as in the first embodiment are identified by like reference numerals, and further description thereof is omitted below.

Method of Controlling the Recording Head According to the Second Embodiment of the Invention The method of controlling the recording head according to the second embodiment of the invention is described below with reference to FIG. 5.

The recording head 18 is controlled by the control unit 33 shown in FIG. 5. Based on the print data and control commands, the control unit 33 selects a specific drive mode, outputs control signals through the head driver 82 to the head coils 10 of the recording head 18, and controls energizing each of the head coils 10. The drive modes are stored in the storage unit 88 of the control unit 33, and specify, for example, the head coil drive frequency f and head coil energize time Pw. The head coil drive frequency f is the frequency of the pulse voltage applied to the head coils 10 of the recording head 18, and means the maximum number of times the recording wire 9 is driven to protrude per unit time (the maximum protrusion operation count).

The drive mode is specified using a combination of two parameters such as the print mode and character quality. The print mode is either normal, which is used for normal printing operations, or copy, which is a mode for printing copies. Note that plural copy modes can be set, such as when printing two copies or four copies, for example. Character quality can be set to draft or letter quality (LQ). The draft mode is set for printing with a lower resolution than a preset reference resolution. The LQ mode is set for printing with resolution at least equal to the reference resolution.

Carriage Scanning Control

Figure 10:
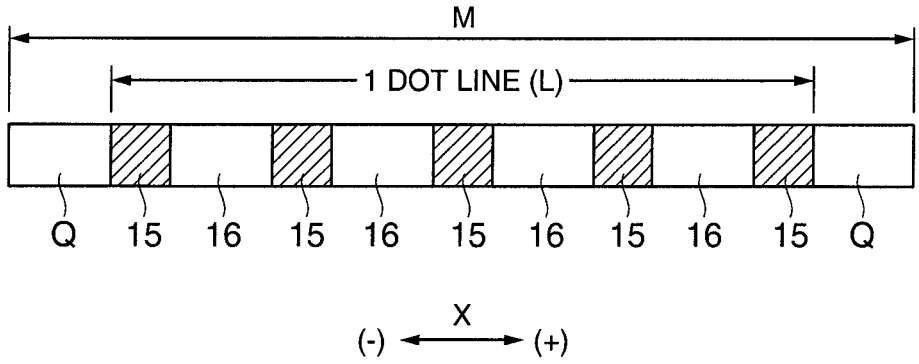
FIG. 10 shows the carriage drive periods and the distribution of the pattern detection areas on each dot line in a second embodiment of the invention.

Scanning control of the carriage that carries the recording head is described next with reference to FIG. 5, FIG. 7, FIG. 10, and FIG. 11. The second embodiment of the invention uses carriage scanning control, or more particularly a rest period in the carriage scanning operation, to reduce excessive rise in the temperature of the recording head. FIG. 10 shows the carriage scanning period and the distribution of pattern detection areas on each dot line. FIG. 11 is a control table for determining the rest time.

Carriage 19 scanning is controlled by the control unit 33 shown in FIG. 5. The control unit 33 outputs a control signal to the carriage motor 69 of the carriage drive mechanism 60 through the motor driver 84 to control carriage 19 scanning. As described above, the carriage 19 is guided by the carriage guide shaft 32 through an intervening timing belt 35 (see FIG. 2) and travels bidirectionally on the x-axis shown in FIG. 1 as a result of forward or reverse rotation of the carriage motor 69. The range of carriage 19 travel on the x-axis is referred to below as the scanning period M (see FIG. 10).

As shown in FIG. 10, the scanning period M of the carriage 19 is segmented into printable period L and standby periods Q. One line composed of a plurality of dot lines L is recorded by a plurality of recording wires 9 of the recording head 18 in the printable period L. Note that because a dot line is formed through the entire printable period L, the same symbol L is used in reference to the dot line.

In this embodiment of the invention the printable period L is composed of one dot line that is a maximum 136 columns wide (one column being the width of one character), and five pattern detection areas 15 are set within the range of the maximum column count of one dot line L. More specifically, the pattern detection areas 15 are distributed so that a pattern detection area 15 is set at the left and right ends of the 136 columns and the remaining three pattern detection areas 15 are distributed evenly between the end pattern detection areas 15. If the width of each pattern detection area is 8 columns, the width of the non-detection area 16 between neighboring pattern detection areas 15 is 24 columns. Note the dot line L shown in FIG. 6 is recorded by one recording wire 9 of the recording head 18.

As shown in FIG. 10, a standby period Q is placed on each end of the printable period L. The recording head 18 does not print in the standby periods Q, which are used to slow the speed of the carriage 19, reverse direction, pause (stop) scanning as necessary, or accelerate. The recording paper S is generally conveyed while the carriage 19 is in a standby period Q.

The control unit 33 shown in FIG. 5 also outputs control signals to each of the head coils 10 of the recording head 18 as described above, and controls energizing the head coils 10. The detection signal of the temperature detector 14 disposed to the frame 56 of the recording head 18 shown in FIG. 3 and FIG. 4 is also input to the control unit 33. The control unit 33 determines based on the detection signal from the temperature detector 14 if the recording head 18 exceeds a preset threshold temperature during printing. Based on this decision, the control unit 33 controls the scanning operation of the carriage 19, that is, determines the scanning rest time setting of the carriage 19. The storage unit 88 of the control unit 33 stores data used to determine the rest time and control during the rest time.

As shown in FIG. 7A and FIG. 7B, the first dot pattern P1 used as a specific bit image is formed by any same recording wire 9 continuously recording 50 dots, for example, and the second dot pattern P2 is formed by any same recording wire 9 recording, for example, 25 dots every other dot in the same length as the continuously recorded 50 dots. Before printing each dot line L, the control unit 33 determines if either the first dot pattern P1 or the second dot pattern P2 is contained in each of the five pattern detection areas 15 of the dot line L to be printed. The number of pattern detection areas 15 (specific areas) containing either the first dot pattern P1 or the second dot pattern P2 in the dot line L to be printed is also counted, and whether this count is greater than or equal to a preset reference number N, or is less than the reference number N, is determined. Based on the result of this decision, the control unit 33 then determines the rest time of the carriage 19 (recording head 18) when printing that dot line L. In this embodiment of the invention any of the numbers 2, 3, 4, and 5 can be set as this reference number N.

The control table shown in FIG. 11 for determining the rest time is described next. The number of specific areas and the print quality setting specified for the print data containing the dot line L to be printed are used as parameters for determining the rest time of the carriage 19 in this embodiment of the invention. Print quality is specified by the combination of two parameters, that is, the two print mode settings of normal and copy, and the two character quality settings of draft and letter quality (LQ).

As described above, this embodiment of the invention determines based on the detection signal from the temperature detector 14 if the temperature of the recording head 18 exceeds a preset threshold temperature T, and based on the result of this decision determines the rest time of the carriage 19 (recording head 18) when printing each dot line L. For example, this embodiment of the invention uses three different threshold temperatures T as the threshold temperature T. In the control table shown in FIG. 11, the values shown in the columns labelled "specific bit image" are used when the number of specific areas is greater than or equal to the reference number N, and the values in columns labelled "not-specific bit image" are used when the number of specific areas is less than the reference number N. As shown in the control table, each of the four print quality settings rendered by two print mode and character quality settings is divided into two cases, that is, whether the number of specific areas is greater than or equal to the reference number N (specific bit image), and whether the number of specific areas is less than the reference number N (not-specific bit image), resulting in 8 patterns for which three different threshold temperature settings are preset.

In addition to the set threshold temperatures T, the control table also shows the output values R of the temperature detector 14 at each threshold temperature T, that is, the output values of the thermistor. As shown in FIG. 11, the three threshold temperature T settings each have two levels, a setting (second temperature) for when the number of specific areas is greater than or equal to the reference number N (specific bit image), and a setting (first temperature) for when the number of specific areas is less than the reference number N (not-specific bit image).

The lowest threshold temperature T of the three threshold temperatures T is case 1, and the output value of the temperature detector 14 at this threshold temperature T is R1. The control unit 33 compares the output value R of the temperature detector 14 with R1 to determine the rest time H. In this embodiment of the invention the setting of each temperature of the rest times H differs according to the print quality setting. The values shown in the control table in FIG. 11 show the ratio K (%) multiplied by the standard rest time Hst. Note that the standard rest time Hst is preferably a maximum of approximately 1 second. In addition, the ratio K multiplied by the standard rest time Hst is preferably set using two values, ratio K1 and ratio K2, for example. These can be used according to the print data and the drive mode. The temperature may also be divided into smaller increments and the number of ratios increased.

The next lowest threshold temperature T is case 2, and the output value R of the temperature detector 14 at this threshold temperature T is R2. The control unit 33 compares the output value R of the temperature detector 14 with R2 to determine the rest time H. The highest threshold temperature T is case 3, and the output value R of the temperature detector 14 at this threshold temperature T is R3.

Printing Process Flow

Figure 12:
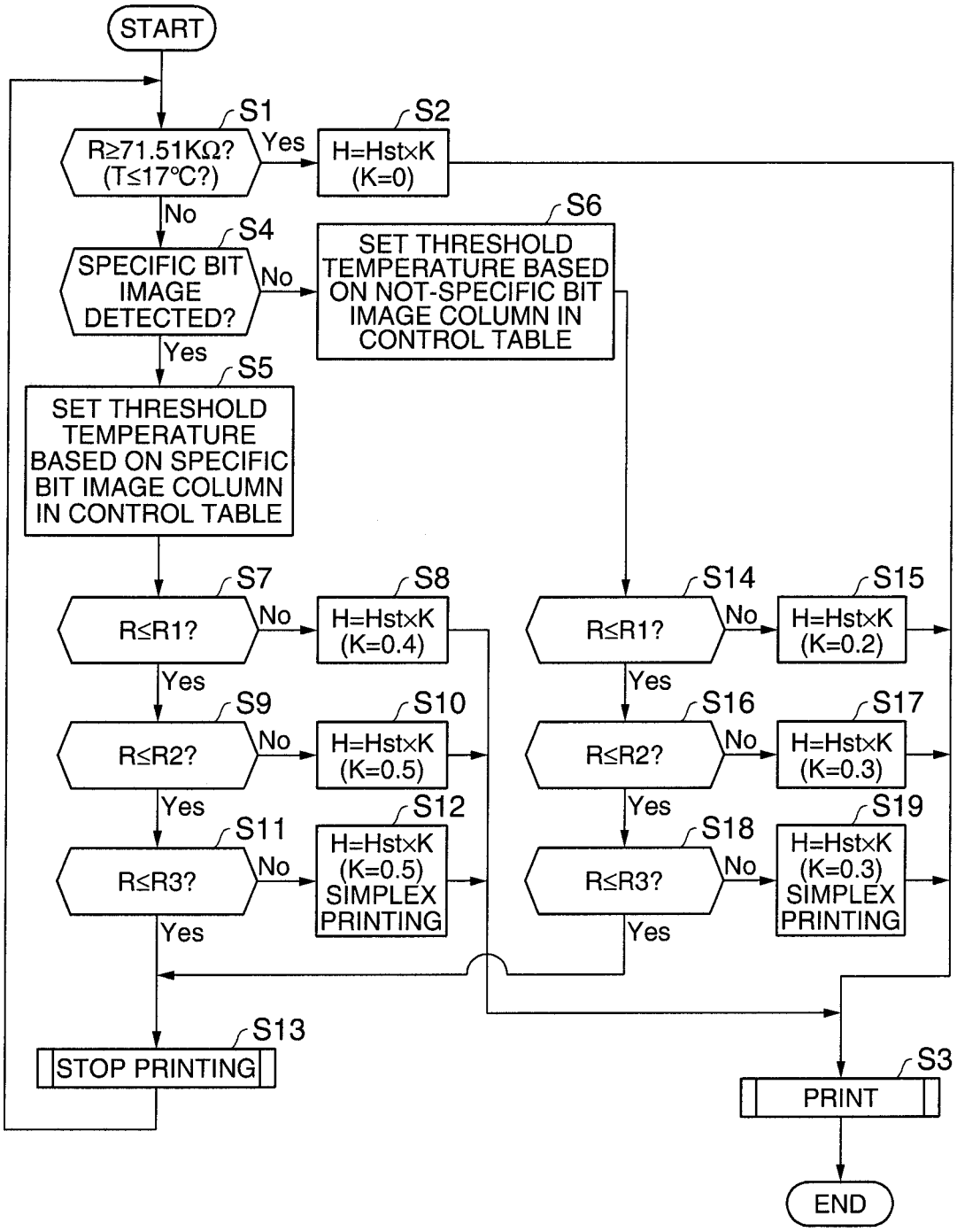
FIG. 12 is a flow chart of the printing process in the second embodiment of the invention.

The flow of the dot line printing process is described next with reference to FIG. 11 and FIG. 12. FIG. 12 is a flow chart showing the dot line printing process using the control table. Note that in the example described below the print mode is normal and the character quality is draft.

In step S1 in FIG. 12 the control unit 33 detects the output value R of the temperature detector 14 and compares it with the output value corresponding to the preset threshold temperature T. The threshold temperature T that is used in this step is an even lower value than case 1, which is the lowest temperature of the three threshold temperatures T described above, and in this embodiment is set to 17° C. (the corresponding output value of the temperature detector 14 is 71.51 kΩ). If the temperature of the recording head 18 is less than or equal to the threshold temperature T, that is, if R≥71.51 kΩ (step S1 returns Yes), the temperature of the recording head 18 is determined to be sufficiently low and control goes to step S2.

The rest time H under this condition is set in step S2. The control unit 33 selects case C0 from the control table shown in FIG. 11. In case C0 the ratio K multiplied by the standard rest time Hst is 0% and the rest time H is therefore 0, that is, the carriage 19 is set to decelerate, change direction, and accelerate in standby period Q with setting a rest time H. Control then goes to step S3.

In step S3 the dot line L to be printed is printed in the preset drive mode. The process then ends.

If in step S1 in FIG. 12 the temperature t of the recording head 18 exceeds the threshold temperature T (step S1 returns No), control goes to step S4.

The control unit 33 detects and evaluates a specific bit image in step S4. More particularly, the control unit 33 detects if the specific bit image (first dot pattern P1 or second dot pattern P2) is found in the five pattern detection areas 15 shown in FIG. 10, and compares the number detected with the reference number N. If the number of pattern detection areas 15 (specific areas) in which a specific bit image is found is greater than or equal to N (step S4 returns Yes), control goes to step S5.

In step S5 the control unit 33 references the control table in FIG. 11, and selects the temperatures in the specific bit image column of the print quality specified for the current print data as the three threshold temperatures T. The control unit 33 then sets the output values R1, R2, R3 corresponding to the selected threshold temperatures as the criteria to be used to set the rest time H.

If in step S4 the number of pattern detection areas 15 in which the specific bit image was found is less than N (step S4 returns No), control goes to step S6.

In step S6 the control unit 33 references the control table in FIG. 11, and selects the temperatures in the not-specific bit image column of the print quality specified for the current print data as the three threshold temperatures T. The control unit 33 then sets the output values R1, R2, R3 corresponding to the selected threshold temperatures T as the criteria to be used to set the drive mode.

If control goes to step S5 as a result of the decision from step S4 in FIG. 12, the output value R of the temperature detector 14 is compared with R1, R2, R3 in steps S7 to S12, and the rest time H is set based on the results of these steps. The three threshold temperatures (second temperature) set in step S5 at this time are 65° C., 75° C., 107° C.

In step S7 the output R of the temperature detector 14 is first compared with output R1 corresponding to case 1 (65° C.), that is, the lowest threshold temperature. If R>R1 (recording head 18 temperature t<65° C.) (step S7:No), control goes to step S8, and the rest time H is set according to these conditions. Because the ratio K multiplied by the standard rest time Hst is 40% as shown in the control table in FIG. 11, the control unit 33 determines the rest time H to be 0.4×Hst, that is, sets a rest time H of 0.4×Hst in the standby period Q. Control then goes to step S3.

In step S3 the dot line L to be printed is printed in the preset drive mode. The process then ends.

However, if in step S7 R≤Rin (recording head 18 temperature t≥65° C.) (step S7:Yes), control goes to step S9, and the output R of the temperature detector 14 is compared with output value R2 corresponding to case 2 (75° C.). If R>Rhh (recording head 18 temperature t<75° C.) (step S9:No), control goes to step S10, and the rest time H is set according to these conditions. Because the ratio K multiplied by the standard rest time Hst is 50% as shown in the control table in FIG. 11, the control unit 33 determines the rest time H to be 0.5×Hst, that is, sets a rest time H of 0.5×Hst in the standby period Q. Control then goes to step S3.

In step S3 the dot line L to be printed is printed in the preset drive mode. The process then ends.

If in step S9 R≤Rhh (recording head 18 temperature t≥75° C.) (step S9:Yes), control goes to step S11 and the output R of the temperature detector 14 is compared with output value R3 corresponding to case 3 as the stop printing condition (107° C.). If R>R3 (recording head 18 temperature t<107° C.) (step S11:No), control goes to step S12, and the rest time H is set according to these conditions. Because the ratio K multiplied by the standard rest time Hst is 50% as shown in the control table in FIG. 11, the control unit 33 determines the rest time H to be 0.5×Hst, that is, sets a rest time H of 0.5×Hst in the standby period Q, and determines to print on only one pass of the bidirectional carriage scan. Control then goes to step S3.

In step S3 the dot line L to be printed is printed in the preset drive mode. The process then ends.

However, if in step S11 R≤R3 (recording head 18 temperature t≥107° C.) (step S11:Yes), control goes to step S13 and printing stops for a preset delay time (a time sufficient for the recording head 18 to cool). Control then goes to step S1 and processing resumes.

If control goes to step S6 as a result of step S4 in FIG. 9, the output value R of the temperature detector 14 corresponding to temperature t of the recording head 18 is compared with the output values R1, R3, R3 of the temperature detector 14 corresponding to the threshold temperatures T in steps S14 to S19, and the rest time H is set based on the results of these steps.

In step S6 the threshold temperatures T (first temperature) are 102° C., 107° C., 110° C., respectively. Steps S14 to S19 are the same as steps S7 to S12 except that the three threshold temperatures T are higher than the threshold temperatures T used in steps S7 to S12.

Note that the rest time H settings in steps S8, S10, and S12 are the same as the settings in steps S15, S17, and S19, respectively. More specifically, in this embodiment as shown in FIG. 8 and FIG. 9, the threshold temperatures T of the recording head 18 for changing the rest time H to the settings shown in step S8, S10, S12 are lower in the case of a specific bit image than in the case of a not-specific bit image, and in the case of a specific bit image, a rest time H that can be expected to have a better heat dissipation (cooling) effect is set even if the recording head 18 temperature is the same.

While an example in which the print mode is set to normal and the character quality is set to draft is described above, the same process is executed based on the control table shown in FIG. 11 when a different mode is set, such as when the print mode is set to copy or the character quality is set to letter quality.

The effect of this embodiment is described below.

(1) The recording head 18 control method described above can prevent an excessive rise in the temperature of the head coils 10 of the recording head 18 by resting the recording head 18 in a standby period Q that is outside the printable period L of the recording head 18. In addition, the control unit 33 determines if the number of first dot patterns P1 and second dot patterns P2, which are specific bit images that could cause a sudden temperature rise in the head coils 10, contained in the dot line L to be printed exceeds a reference number N, and determines the rest time H in the printing operation of the recording head 18 accordingly. As a result, a sudden rise in the temperature of the head coil 10 can therefore be determined by a simpler method than when controlling energizing the head coils 10, for example.

(2) The recording head 18 control method described above can prevent a sudden temperature rise in the head coils 10 while the drive mode of the recording head 18 remains the same. Controlling the dot impact printer 100 can therefore be prevented from becoming more complicated.

(3) The recording head 18 control method described above compares the pattern detection areas 15 in the dot line L to be printed with a specific bit image, and if the number of pattern detection areas 15 containing the specific bit image is greater than or equal to a reference number N, changes the threshold temperature of the recording head 18 used to set a rest time H to a low temperature (second temperature). If less than the reference number N, however, the threshold temperature of the recording head 18 for setting the rest time H is set to a higher temperature (first temperature) than the second temperature. As a result, the rest time H can be set to a short time when the number of pattern detection areas 15 containing the specific bit image is 1 or less and the temperature of the recording head 18 is anticipated to not exceed the burnout threshold temperature of the head coil 10. Burnout of the head coil 10 can therefore be prevented and a drop in printer throughput can be suppressed.

A third embodiment of the invention is described next with reference to accompanying figures. Note that parts and content of the third embodiment that are the same as in the first or second embodiment are identified by like reference numerals, and further description thereof is omitted below. Note that this third embodiment of the invention differs from the first and second embodiments in the configuration of the dot impact printer.

Dot Impact Printer Configuration

Figure 13:
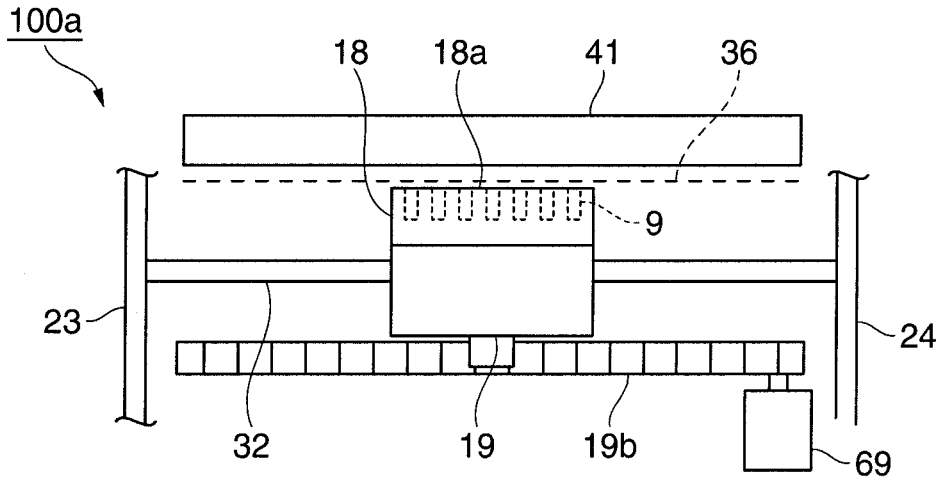
FIG. 13 schematically describes the configuration of a dot impact printer according to a third embodiment of the invention.

The configuration of a dot impact printer according to the third embodiment of the invention is described first below. FIG. 13 schematically describes the configuration of a dot impact printer according to the third embodiment of the invention.

As shown in FIG. 13, the dot impact printer 100*a* has a carriage guide shaft 32 extending transversely between the left and right side panels 23, 24 of the printer frame. A carriage 19 that carries a recording head 18 is configured to move bidirectionally along this carriage guide shaft 32 widthwise to the printer based on output from a carriage motor 69 by means of a drive mechanism 19*b* such as a timing belt 35 and pulley not shown. A platen 41 opposes the recording head 18 with a constant gap therebetween. Recording paper is conveyed passed the printing position determined by the platen 41 through a recording paper transportation path that passes the printing position. The recording paper is conveyed in conjunction with the printing operation of the recording head 18 through the recording paper transportation path by a paper feed mechanism 40, and is discharged outside the dot impact printer 100 when printing ends.

An ink ribbon 36 pulled from an ink ribbon cassette not shown is loaded into the gap between the recording head 18 and platen 41 across the head surface 18*a* of the recording head 18. The ink ribbon 36 is configured so that the used portion can be sequentially rewound on a takeup spindle not shown. The recording head 18 has a plurality of recording wires 9 and a head coil 10 such as a solenoid coil for driving each recording wire 9. The distal ends of the recording wires 9 can be driven to protrude from the head surface 18*a* to the platen 41 by means of drive power from the corresponding head coil 10. The plural recording wires 9 are arrayed in the head surface 18*a* so that each recording wire 9 forms one dot of the print data. For example, 24 recording wires 9 can be arrayed in two rows of 12 in the head surface 18*a*.

When the head coil 10 is energized, the recording wire 9 corresponding to the energized head coil 10 strikes the recording paper on the platen 41 through the ink ribbon 36. As a result, a dot is formed on the recording paper by the ink from the ink ribbon 36. When pressure sensitive paper is conveyed with the recording paper, a dot is also formed at the same position on the pressure sensitive paper. The dot impact printer 100*a* prints one dot line at a time by energizing the head coils 10 based on the print data to cause the corresponding recording wires 9 to protrude at the necessary time while the carriage 19 traverses over the paper. When printing one dot line is completed, the recording paper is advanced one dot line and the next dot line is printed.

The recording head control method and printing process flow are the same as the method, control, and processes of the first embodiment and second embodiment described above.

As in the first embodiment and the second embodiment, this embodiment of the invention compares the pattern detection areas 15 in the dot line to be printed with a specific bit image. When the number of pattern detection areas 15 containing the specific bit image is greater than or equal to reference number N, the threshold temperature of the recording head 18 for changing to a drive mode with less heat output and a slower printing speed is set to a low temperature (second temperature). If less than the reference number N, however, the threshold temperature of the recording head 18 used to change to a drive mode that produces less heat and has a slower print speed is set to a higher temperature (first temperature) than the second temperature. As a result, the recording head 18 drive mode does not change to a drive mode that produces less heat and has a slow print speed when the number of pattern detection areas 15 containing the specific bit image is 1 or less and the temperature of the recording head 18 is anticipated to not exceed the burnout threshold temperature of the head coil 10. Burnout of the head coil 10 can therefore be prevented and a drop in printer throughput can be suppressed.

Preferred embodiments of the invention are described above, and it will be obvious to one with ordinary skill in the related art that the foregoing embodiments can be changed in various ways without departing from the scope of the accompanying claims. Examples of such variations are described below.

Variation 1

The foregoing embodiments describe two types of specific bit images, a first dot pattern P1 that is formed by a single recording wire continuously forming 50 dots, and a second dot pattern P2 that is formed by a single recording wire forming 25 dots in the space of 50 continuous dots by skipping every other dot. Other dot patterns can be used as a specific bit image, however.

For example, the number of dots that are formed continuously (that is, the number of times the corresponding head coil 10 is driven continuously) when the specific bit image is a series of consecutive dots can be set according to the width of each pattern detection area 15, the gap between neighboring pattern detection areas 15, or the maximum length (maximum column count) of the dot line, for example. Alternatively, a dot pattern formed by more than a specified percentage of the dot count equal to the width of the pattern detection area 15 could be used as a specific bit image. Further alternatively, a configuration in which a specified number or more of the plural recording wires 9 in the recording head 18 simultaneously form the first dot pattern P1 or second dot pattern P2 is treated as a specific bit image is also conceivable.

Variation 2

In the foregoing embodiments plural pattern detection areas 15 are set in the range of the dot line, and the specific bit images are detected only in the pattern detection areas 15. However, a configuration that detects how many specific bit images are within the maximum length of the dot line without setting pattern detection areas 15, and determines the drive mode based on how many are detected, is also conceivable. Alternatively, the number of pattern detection areas 15 may be increased and the width of the non-detection areas between neighboring pattern detection areas 15 could be shortened.

Variation 3

Processing does not change according to the content of the detected specific bit images (that is, whether first dot pattern P1 or second dot pattern P2 is detected) in the foregoing embodiments, but the drive mode settings could be changed according to the content of the detected specific bit image. Yet further, the interval between plural pattern detection areas 15 in which a specific bit image is detected, the dot density of areas near the specific bit image, or the printing content (print history) before printing the dot line to be printed, for example, could be used as parameters for setting the drive mode.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

Text in the Figures

FIG. 5
HOST COMPUTER 89
INTERFACE UNIT 85
CONTROL DEVICE 80
CONTROL UNIT 33
CPU 86
DATA PROCESSING UNIT 87
STORAGE UNIT 88
HEAD DRIVER 82
MOTOR DRIVER 84
PRINT ASSEMBLY 50
PRINT MECHANISM 30
RECORDING HEAD 18
HEAD COIL 10
CARRIAGE DRIVE MECHANISM 60
CARRIAGE MOTOR 69
paper feed MECHANISM 40
DETECTION UNIT 68
TEMPERATURE DETECTOR 14
FIG. 6, FIG. 10
1 DOT LINE
FIG. 8
PRINT MODE
NORMAL
COPY
PRINT INTERVAL CONDITION
UNIDIRECTIONAL PRINT CONDITION
STOP PRINTING CONDITION
HEAD COIL DRIVE INTERVAL
SYMBOL
CHARACTER QUALITY
DRAFT MODE
LETTER QUALITY MODE
NOT-SPECIFIC BIT IMAGE
SPECIFIC BIT IMAGE
FIG. 9
START
S3 PRINT
S4 SPECIFIC BIT IMAGE DETECTED?
S5 SET THRESHOLD TEMPERATURE BASED ON SPECIFIC BIT IMAGE COLUMN IN CONTROL TABLE
S6 SET THRESHOLD TEMPERATURE BASED ON NOT-SPECIFIC BIT IMAGE COLUMN IN CONTROL TABLE
S8 HEAD COIL DRIVE INTERVAL: Tin1

S13 STOP PRINTING
S19 HEAD COIL DRIVE INTERVAL: Tin2; UNIDIRECTIONAL PRINTING
END
Key
f: HEAD DRIVE FREQUENCY (kHz)
Pw: HEAD COIL ENERGIZE TIME
N: NORMAL MODE
C: COPY MODE
Pwn: REFERENCE ENERGIZE TIME IN NORMAL MODE
Pwc: REFERENCE ENERGIZE TIME IN COPY MODE
Tin1: HEAD COIL DRIVE INTERVAL (INITIAL)
Tin2: HEAD COIL DRIVE INTERVAL (HIGH TEMPERATURE)
Rin: PRINT INTERVAL CONDITION
Rhh: UNIDIRECTIONAL PRINTING CONDITION
Rst: STOP PRINTING CONDITION
FIG. 11
PRINT MODE
NORMAL
COPY
CASE C1
PAUSE TIME
CHARACTER QUALITY
DRAFT MODE
LETTER QUALITY MODE
NOT-SPECIFIC BIT IMAGE
SPECIFIC BIT IMAGE
FIG. 12
START
S3 PRINT
S4 SPECIFIC BIT IMAGE DETECTED?
S5 SET THRESHOLD TEMPERATURE BASED ON SPECIFIC BIT IMAGE COLUMN IN CONTROL TABLE
S6 SET THRESHOLD TEMPERATURE BASED ON NOT-SPECIFIC BIT IMAGE COLUMN IN CONTROL TABLE
S12 SIMPLEX PRINTING
S13 STOP PRINTING
S19 SIMPLEX PRINTING
END

What is claimed is:

1. A control method for a recording head of a dot impact printer that prints information on a recording medium by driving recording wires of a recording head that has a plurality of recording wires while a carriage that carries the recording head traverses the recording medium, each of the recording wires being allocated to printing one dot line in the scanning direction of the carriage, the control method comprising steps of:

during dot line printing:

setting a predetermined number of pattern detection areas of a specified width within the maximum line length of the dot line;

determining before printing if a pattern detection area in the dot line to be printed is a specific area containing previously defined specific dot patterns;

determining if a number of specific areas containing previously defined specific dot patterns in the dot line is greater than or equal to a reference number of 2 or more; and printing the dot line based on the result of the decision.

2. The recording head control method described in claim 1, further comprising a step of:

during dot line printing, determining the drive mode of the recording head for printing the dot line.

3. The recording head control method described in claim 2, further comprising steps of:

during dot line printing based on the results of these decisions, determining the drive mode of the recording head for printing the dot line.

4. The recording head control method described in claim 2, further comprising steps of:

presetting a plurality of drive modes with different heat output as the drive modes of the recording head, and correlating the drive modes with the temperature of the recording head, the temperature of the recording head correlated to each drive mode including at least two temperature settings, a first temperature and a second temperature that is lower than the first temperature; and during dot line printing, detecting the temperature of the recording head before printing; selecting the drive mode corresponding to the detected recording head temperature using the second temperature when the number of specific areas in the dot line to be printed is greater than or equal to the reference number;

selecting the drive mode corresponding to the detected recording head temperature using the first temperature when the number of specific areas in the dot line to be printed is less than the reference number; and printing the dot line using the selected drive mode.

5. The recording head control method described in claim 4, further comprising a step of:

when the recording head temperature detected before printing is less than or equal to a preset threshold temperature, determining the drive mode of the recording head without using the result of determining whether or not the pattern detection areas are the specific area.

6. The recording head control method described in claim 2, further comprising steps of:

relating print quality of the print data, and the drive mode of the recording head; and during dot line printing, accomplishing dot line printing using the drive mode selected from among the drive modes related to the print quality of the print data containing the dot line to be printed.

7. The recording head control method described in claim 1, further comprising a step of:

setting the specific dot pattern based on the number of recording wires driven simultaneously when printing, and a consecutive drive count of a same recording wire.

8. The recording head control method described in claim 1, further comprising a step of:

during dot line printing, determining a rest time in the dot line printing period based on the decision.

9. The recording head control method described in claim 8, further comprising steps of:

setting a plurality of pattern detection areas of a specific width in an area of the maximum line length of the dot line; and during dot line printing, determining before printing if the pattern detection area in the dot line to be printed is a specific area containing the specific dot pattern, determining if the number of specific areas in the dot line is greater than or equal to the reference number, and based on the results of these decisions, determining the rest time between dot line printing operations.

10. The recording head control method described in claim 8, further comprising steps of:

presetting a plurality of rest times between dot line printing operations of the recording head, and correlating each rest time to a temperature of the recording head, the recording head temperature correlated to each rest time including at least two temperature settings, a first temperature and a second temperature that is lower than the first temperature; and during dot line printing, detecting the temperature of the recording head before printing, selecting the rest time corresponding to the detected recording head temperature using the second temperature when the number of specific areas in the dot line to be printed is greater than or equal to the reference number; selecting the rest time corresponding to the detected recording head temperature using the first temperature when the number of specific areas in the dot line to be printed is less than to the reference number; and pausing printing during the dot line printing operation based on the selected rest time.

11. The recording head control method described in claim 8, further comprising steps of:

when the recording head temperature detected before printing is less than or equal to a preset threshold temperature, determining the rest time of the recording head without using the result of determining whether or not the pattern detection areas are a specific area.

12. The recording head control method described in claim 8, further comprising steps of:

relating the print quality of the print data, and the rest time of the recording head; and during dot line printing, pausing printing during the dot line printing operation for the rest time selected from among the rest times related to the print quality of the print data containing the dot line to be printed.

13. The recording head control method described in claim 1, further comprising steps of:

printing in a direction of the width of a recording paper based on the result of the decision.

14. The recording head control method described in claim 1, further comprising steps of:

moving a recording head carried on a carriage across a platen of a printer while printing based on the result of the decision.

15. The recording head control method described in claim 1, further comprising steps of:

controlling with a control device the feeding of continuous-feed paper to a paper feed mechanism using a push tractor unit; and printing on the continuous-feed paper based on the result of the decision, wherein the control device executes the control method.

16. The recording head control method described in claim 1, further comprising steps of:

controlling the rotation of the carriage drive motor in a first rotation direction to cause to carriage to move in a first direction; and controlling the rotation of the carriage drive motor in a second rotation direction opposite the first rotation direction to cause the carriage to move in a second direction opposite the first direction; and printing onto paper from the carriage based on the results of the decision, wherein the carriage moves during printing.

* * * * *